United States Patent [19]

Brown et al.

[11] Patent Number: 4,726,864

[45] Date of Patent: Feb. 23, 1988

[54] HECTOGRAPH MASTER WEBS AND SHEETS, AND METHOD

[75] Inventors: Albert E. Brown, Locust Valley; Robert T. Emerson, Manhasset, both of N.Y.

[73] Assignee: Leedall Products Incorporated, New York, N.Y.

[21] Appl. No.: 880,681

[22] Filed: Jun. 30, 1986

Related U.S. Application Data

[63] Continuation-in-part of Ser. No. 657,203, Oct. 3, 1984, abandoned.

[51] Int. Cl.[4] ..... B41M 5/02; B44C 1/17

[52] U.S. Cl. ..... 156/234; 101/473; 156/334

[58] Field of Search ..... 101/473; 156/334, 234

[56] References Cited

U.S. PATENT DOCUMENTS

| | | | |
|---|---|---|---|
| 2,610,939 | 9/1952 | Fisher | 156/334 |
| 3,117,101 | 1/1964 | Moyer | 156/334 |
| 3,410,711 | 11/1968 | Hoge | 101/473 |
| 4,018,162 | 4/1977 | Sharkey | 101/473 |
| 4,456,649 | 6/1984 | Clarke | 156/334 |

FOREIGN PATENT DOCUMENTS

| | | | |
|---|---|---|---|
| 189846 | 11/1982 | Japan | 156/334 |
| 906934 | 9/1962 | United Kingdom . | |
| 1113695 | 5/1968 | United Kingdom . | |
| 1124082 | 8/1968 | United Kingdom . | |
| 1324796 | 7/1973 | United Kingdom . | |

*Primary Examiner*—Clyde I. Coughenour

*Attorney, Agent, or Firm*—Thomas L. Tully; Marley R. Perman; Clarence A. Green

[57] ABSTRACT

Hectograph master webs and sheets formulated to provide sharper, more-complete transfer under reduced imaging pressures, and sharper, more-numerous duplicate copies in the hectograph duplicating process and resistance to adhesion and coating-transfer under the pressures exerted by a hectograph duplicating machine. The receptive surface formed on the master sheet comprises a hard, pressure-adhesive coating consisting by weight essentially of 45 to 65 percent paraffinic wax, 5 to 20 percent hard wax and 15 to 40 percent polybutene polymer having a Staudinger molecular weight of from 10,400 to 12,300 which bonds to the hectograph transfer layer under relatively low, localized imaging pressure but which is sufficiently hard to resist adhesion, sticking and pick-over to hectograph copy sheets during the hectograph copying processes. The receptive coating also provides a barrier against the migration of the hectograph composition and/or of the spirit duplicating fluid into the master sheet.

8 Claims, No Drawings

HECTOGRAPH MASTER WEBS AND SHEETS, AND METHOD

The present application is a continuation-in-part of copending application Ser. No. 657,203 filed Oct. 3, 1984 now abandoned.

BACKGROUND OF THE INVENTION

Hectograph transfer sheets and master sheets and webs are well-known in the art. Conventional hectograph transfer sheets and webs carry a layer of pressure-transferable duplicating composition, and conventional master sheets and webs are designed to receive mirror-reverse images of hectograph composition from the transfer sheet under the effects of writing or typing pressure applied against the rear surface of the master sheet. The imaged master sheet or web is mounted on a hectograph duplicating machine, generally a spirit duplicating machine, and a plurality of correct-reading duplicate copies are produced. Generally, the hectograph composition contains undissolved hectograph dye and the copy sheets are moistened with a liquid spirit solvent such as an alcohol. However, in some cases the hectograph composition is microporous and contains pressure-exudable fluid ink, and the copies are made by pressing the imaged master against dry copy sheets.

It is desirable to be able to duplicate an imaged master sheet or web from time to time as additional copies are required, such as of printed forms, instruction sheets, clothing patterns, and the like. This is not possible with conventional hectograph master sheets and webs, without substantial loss of copy quality, because the images on the hectograph master migrate into and/or over the master paper surface during periods of storage so that subsequent reduplication efforts produce weak copies and/or blurred copies, i.e., copies of unsatisfactory color intensity and sharpness.

It has been proposed by U. S. Pat. No. 4,018,162 to apply an oil-barrier coating to both surfaces of a continuous master web in order to prevent the master paper from absorbing the oily ink from porous duplicating images applied to the master web, either directly or when the imaged web is rolled up. Such coatings are designed to prevent the master images from drying out during storage. However, they are solvent-applied coatings which are not pressure-adhesive, and which contain porous filler to make them receptive and which are not inert to the conventional spirit solvents. Thus, they have an affinity for the spirit solvents, absorb such solvents to cause the master sheet to swell and curl, and cause soluble dye to be dissolved out of the master images to form broadened or filled-in master images which produce duplicate images which are less sharp or have a blurred appearance.

It is also desirable to be able to image hectograph master webs and sheets in modern automatic line-pressure scribing machines such as plotters, scanners or drafting machines. Such machines have a mechanical stylus pen which is automatically guided over a copy sheet to form images or pictures corresponding to those on a remote original sheet or instructions from a computer program. It has not been found possible to use liquid hectograph ink in such stylus pens to produce masters which can be duplicated. Also, attempts to image conventional hectograph master units using the pressure applied by such stylus pens have been unsuccessful, because the pressure is too low to produce any satisfactory transfer of hectograph composition from the transfer layer to the master sheet, even in cases where the hectograph transfer layer carries an adhesive supercoating.

Attempts to improve the pressure-sensitivity of hectograph master webs and sheets by applying conventional pressure-adhesive soft coatings to the receptive surface thereof have resulted in the creation of other problems, particularly in the case of imaged masters which are duplicated by means of pressure, as in U.S. Pat. No. 4,018,162. Convention soft pressure-adhesive coatings, such as those consisting of paraffin wax and mixtures thereof with lesser amounts polyisobutylene resin, are so soft and adhesive that they stick to and transfer to the master web or sheet, or to parts of the pressure-duplicating machine, so as to be useless for such purpose.

SUMMARY OF THE INVENTION

The present invention relates to novel hectograph master sheets and webs and to the production of receptive master paper which carries a thin pressure-adhesive hard receptive coating which is an inert barrier with respect to the ingredients of the transfer composition of the transfer sheet and also with respect to spirit duplicating fluids, the pressure-adhesive properties of the master coating producing a strong bond with a hectograph transfer layer, even under reduced localized imaging pressures, but being resistant to adhesion and transfer to copy sheets and machine parts under the overall pressures applied during the copying step.

Applicants have discovered that while hectograph master papers have been formulated and/or coated to give them wet strength, image-receptivity, oil resistance or other properties, prior-known hectograph master papers have not been coated with a receptive layer which is adhesive under the effects of localized imaging pressure but is not so adhesive under the effects of the overall pressures exerted by the pressure rolls of a hectograph duplicating machine as to stick to and transfer to the surfaces of the hectograph copy sheets and/or machine rollers, and to produce an imaged master sheet or web having an inert, hard barrier layer which prevents any of the ingredients of the images from migrating into or over the surface of the master sheet, and which further prevents the spirit duplicating fluids from penetrating or wetting the master sheet coating. This prevents the master sheet from swelling or curling, and prevents soluble dye from being dissolved out of the master images onto adjacent areas of the master sheet surface to produce broadened master images having deteriorated duplication properties.

The pressure-adhesive master coating compositions used according to the present invention are hot-melt applied compositions comprising a major amount by weight of a paraffinic wax, a minor amount by weight of one or more harder waxes which are compatible therewith, and a minor amount by weight of a tacky, normally-solid polybutene resin, including polyisobutylene resin, which is compatible with and meltable with said wax mixture to form a homogeneous molten coating composition at temperatures within the range of from about 170° F. to 200° F. Such molten compositions are blade coated over a suitable master paper stock in a weight of between about 0.5 and 5.0 pounds per ream, 3300 square feet, to form a continuous inert hard barrier layer which is not sticky-to-the-touch or under overall or broad pressures but which is at least slightly adhesive under the effects of localized imaging pressure so as to be receptive to the pressure-transfer of hectograph transfer compositions even under low imaging pressures.

The most critical ingredient of the present inert coating compositions is the solid polybutene resin, which comprises from about 15% to about 40% by weight of the composition. The polybutene resin is permanently tacky or adhesive, has sufficient viscosity to prevent it from being absorbed into the master paper, and is inert with respect to oils, dyes, spirit duplicating fluids and water. Suitable polybutene resins are commercially-available under the trademarks Vistanex LMMS and Vistanex LMMH, both of which are solid polyisobutylene polymers of extremely viscous, soft, gummy consistency. The former has an average Staudinger molecular weight of 10,400 to 10,900 and the latter has an average Staudinger molecular weight of 11,600 to 12,300. Similar polybutenes are available under the trademarks Isolene and Oppanol. However, the lower molecular weight liquid polybutenes such as Indopol, molecular weight between 300 and 2600, are unsatisfactory. A minor portion of the polybutene resin may be replaced with another viscous adhesive resin or polymer such as hydrogenated wood rosin provided that the latter is also compatible with the other ingredients. Generally, such secondary resins constitute from about 0% to 15% of the total resin content, preferably no more than about 10% by weight thereof.

The main ingredient of the present compositions, in terms of weight percentage, is the paraffinic wax which preferably comprises from about more than 50% up to about 65% by weight of the coating composition. The paraffinic wax reduces the viscosity of the molten composition to a coatable level, and reduces the adhesive nature of the polybutene in the composition.

While paraffinic waxes possess a degree of tackiness, per se, such tackiness is not sufficient to accomplish the objectives of the present invention in the absence of the polybutene polymer. The latter increases the adhesive properties of the mixture and also the cohesive properties thereof so that the imaged areas of the transfer layer are pulled over to the master coating when the sheets are separated, rather than vice-versa.

The present receptor compositions also contain a minor amount of at least one hard wax which is compatible with both the paraffinic wax and the polybutene polymer, such as carnauba wax or oxidized waxes. Generally, such hard waxes constitute from about 5% to 20% by weight of the total composition, preferably no more than about 15% by weight thereof. Paraffinic waxes are poor solvents or vehicles for tint color additives such as methyl violet isostearate and, therefore, the secondary waxes permit trace amounts of such color additivies to impart a tint color to the receptive coated surface of the master sheet to distinguish said surface from the rear or obverse surface of the master sheet.

The essential ingredients of the present compositions form a diluted homogeneous molten mixture or solution which cools and solidifies to form a solid, hard coating which is not sticky-to-the-touch and which will not stick to the contacting surface of the transfer layer of the hectograph transfer sheet, or to an interposed barrier sheet, when the present units are packaged and stored in large numbers, and/or will not stick to the rear surface of the master sheet in the case of continuous masters which are wound on a roller. Essentially, it is the compatible hard wax, such as carnauba wax, which reduces or masks the adhesive properties of the other ingredients to the point that the receptor layer is adhesive under the effects of localized imaging pressure but is not sufficiently adhesive under the effects of overall or broad pressures, as applied by the pressure duplicating rollers or by the winding of the master web in a roll, to cause sticking or transfer of the receptor coating to the hectograph copy sheets, or to the machine rollers or to the back of the master web.

The following example is given as illustrative of compositions which are suitable master sheet coatings for use according to the present invention.

EXAMPLE 1

The following ingredients are combined in the amounts shown and heated to a temperature of 180° F. to 200° F. to form a homogeneous molten coating composition:

| Ingredients | % By Weight | Range |
|---|---|---|
| Paraffinic wax | 53 | 45–65 |
| Polyisobutylene polymer (Vistanex LMMS) | 25 | 15–40 |
| Carnauba wax | 7 | 5–20 |
| Polybutene resin (high viscosity) | 8 | 0–15 |
| Hydrogenated wood rosin (Staybelite Ester #10) | 7 | 0–15 |

The molten composition has a viscosity between about 200 and 600 centipoises and is blade-coated in a weight of about 3 pounds per ream, 3300 square feet, as a continuous layer to one surface of a master paper web. Thereafter, the coating is cooled to provide the solidified surface layer which is dry and not sticky-to-the-touch but which has a slight stickiness if the thumb is pressed hard thereon against a hard surface.

The coated master web may be cut into sheet lengths or web widths for use with hectograph transfer sheets or webs of similar size, the hectograph transfer layer being positioned against the receptive coated surface of the master sheet or web.

The present units are found to provide excellent transfer of the hectograph composition, such as those disclosed in aforementioned U.S. Pat. No. 4,018,162, to the coated master sheet under the effects of a stylus carrying a weight of 16 ounces, whereas a unit consisting of the same hectograph transfer sheet and a conventional hectograph master sheet provides little or no transfer under the same conditions.

The present hot-melt-coated master sheets and webs produce improved imaging and duplicating results when used in association with conventional hectograph transfer sheets of all types, including hot-melt wax hectograph transfer compositions, solvent-coated, resin-based hectograph transfer compositions and solvent-coated or hot-melt coated microporous transfer compositions, as disclosed in U.S. Pat. No. 4,018,162, which produce master images which produce duplicate copies under the effects of pressure and in the absence of duplicating fluids.

Variations and modifications of the present invention will be apparent to those skilled in the art within the scope of the present claims.

Having thus described the invention, what is claimed is:

1. A pressure-sensitive imaged master sheet or web having thereon a plurality of migration-resistant duplicating images applied thereto under the effects of imaging pressure, said master sheet comprising a flexible paper foundation having an image-receptive surface coating comprising from about 0.5 to 5 pounds per 3300 sq. ft. of a thin, hard receptive layer of a hot-melt-applied composition consisting essentially of from 45% to 65% by weight of paraffinic wax, 5% to 20% by weight of a hard wax which is compatible with said paraffinic wax, and from 15% to 40% by weight of a normally-solid polybutene polymer having a Staudinger molecular weight of from 10,400 to 12,300, said receptive layer having on the surface thereof said plurality of duplicating images, and being nonsticky to the touch or to overall broad pressures but being sufficiently tacky under the effects of relatively low localized imaging pressure to bond to a frangible layer of duplicating composition and to pull over a substantial imagewise portions of said frangible layer to said master sheet in the form of said plurality of duplicating images when said sheets are separated, said receptive layer being an inert barrier with respect to the ingredients of said duplicating images and being resisting to sticking to copy sheets pressed thereagainst in a duplicating machine.

2. A master or web according to claim 1 in which said receptive layer comprises over 50% by weight of a paraffinic wax, and 5% to 15% by weight of a hard wax.

3. A master sheet or web according to claim 2 in which said hard wax comprises carnauba wax.

4. A master sheet or web according to claim 2 in which said receptive layer also comprises up to 15% by weight of rosin.

5. A method for improving the pressure transferability of a hectograph transfer layer to a hectograph master sheet or web under the effects of localized imaging pressure and for producing migration-resistant hectograph duplicating images on said master sheet, comprising the step of coating said hectograph master sheet with from about 0.5 to 5 pounds per 3300 sq. ft. of a thin layer of a hot-melt composition consisting essentially of from 45% to 65% by weight of a paraffinic wax from 5% to 20% by weight of a compatible hard wax and, from 15% to 40% by weight of a normally-solid polybutene polymer having a Staudinger molecular weight of from 10,400 to 12,300, and cooling said layer of form a hard receptive layer which is not sticky to the tough or to overall board pressures which is sufficiently tacky under the effects of relatively low localized imaging pressure to bond to a hectograph transfer layer and pull over substantial imagewise portions thereof, said receptor layer being an inert barrier with respect to the ingredients of said hectograph transfer layer, superposing said master sheet with its receptive layer in contact with the hectograph transfer layer of a hectograph transfer sheet, and applying imaging pressure against said master sheet by means of a relatively light weight stylus to cause substantial imagewise portions of said transfer layer to bond to said receptive layer and to transfer thereto in the form of migration-resistant hectograph duplicating images when said master sheet and transfer sheet are separated.

6. Method according to claim 5 in which said receptive layer comprises over 50% by wight of a paraffinic wax, and 5% to 15% by weight of a hard wax.

7. Method according to claim 6 in which said hard wax comprises carnauba wax.

8. Method according to claim 6 in which said receptive layer also comprises up to 15% by weight of rosin.

* * * * *